US005837123A

United States Patent [19]

Wong et al.

[11] Patent Number: 5,837,123

[45] Date of Patent: Nov. 17, 1998

[54] PREVENTION OF CATHODE CORROSION DURING ELECTROWINNING

[75] Inventors: Fook-Sin Wong, Jindalee; Sharon Wild, Paddington, both of Australia

[73] Assignee: MIM Holdings Limited, Queensland, Australia

[21] Appl. No.: 762,471

[22] Filed: Dec. 9, 1996

Related U.S. Application Data

[63] Continuation of Ser. No. 504,208, Jul. 19, 1995, abandoned.

[30] Foreign Application Priority Data

Jul. 21, 1994 [AU] Australia ..... PM6946

[51] Int. Cl.[6] ..... C25C 1/12

[52] U.S. Cl. ..... 205/574; 205/575; 205/580; 205/581; 205/582; 205/504; 205/585

[58] Field of Search ..... 205/574, 575, 205/580, 581, 582, 584, 585

[56] References Cited

U.S. PATENT DOCUMENTS

| | | | |
|---|---|---|---|
| 3,883,403 | 5/1975 | Ettel | 205/560 |
| 5,215,646 | 6/1993 | Wolski | 205/77 |
| 5,366,612 | 11/1994 | Clouser | 205/73 |
| 5,468,353 | 11/1995 | Anich | 205/581 |

*Primary Examiner*—Kathryn L. Gorgos
*Assistant Examiner*—Edna Wong
*Attorney, Agent, or Firm*—Panitch Schwarze Jacobs & Nadel, P.C.

[57] ABSTRACT

A method to prevent corrosion of a stainless steel cathode in a copper electrowinning system uses compounds added to the electrowinning solution which reduce the level of free chlorine. Examples of such compounds are thiourea, alkyl sulphonate surfactants and protein glues.

5 Claims, 1 Drawing Sheet

PREVENTION OF CATHODE CORROSION DURING ELECTROWINNING

This application is a continuation of U.S. application Ser. No. 08/504,208, filed. Jul. 19, 1995, abandoned.

FIELD OF THE INVENTION

This invention relates to a system to prevent, or at least reduce, corrosion of a steel cathode during copper electrowinning.

BACKGROUND ART

Electrowinning of metals, and particularly of copper, from an aqueous solution is a known process. The process includes an electrolytic cell containing an anode (typically lead) and a cathode (which may be steel). An aqueous solution containing a desired dissolved metal salt is provided. Current is passed through the cell causing deposition of metal on the cathode. Oxygen is usually liberated at the anode. The cathode containing the deposited metal is removed and the metal is removed from the cathode, usually by physical stripping. To allow the cathode to be re-useable many times, it is desirable that the cathode is substantially inert, and is not consumed or corroded during the process. Steel cathodes are therefore preferred and typically a stainless steel cathode is provided.

Electrowinning is distinct from electrorefining. In electrorefining, a metal can be purified by providing an impure metal anode, a cathode and aqueous conducting solution. Current is passed through the cell causing the impure metal to leave the anode and be deposited in a purified form on the cathode. The conductive solution is separately prepared and therefore does not contain unwanted contaminants. To assist in smooth plating of the metal on the cathode, it is known to add additives like glue, thiourea and AVITONE (trade mark of E. I. DU PONT DE NEMOURS & CO INC). U.S. Pat. No. 3,389,064 exemplifies the electrorefining procedure.

Electrowinning of copper from solution is used as part of the copper isolation process. In this process, copper is leached or otherwise separated from its ore. The leached copper is extracted with an organic solvent by a solvent extraction step. The pregnant solvent is subsequently stripped by an aqueous solution to remove the water-soluble copper salts. The aqueous solution is passed into a cell for the electrowinning step. Thus, the electrowinning solution is not separately prepared, but instead is the stripping solution of the pregnant solvent. To minimise disruption to the copper isolation process, the solvent extraction and the stripping steps are either continuous, or conducted with minimum disruption to the entire process. It can therefore be seen that the electrowinning solution can contain various contaminants which have been passed through the process from the initial leach solution. It is generally not efficient to introduce separate purification steps to attempt to reduce or rid all the contaminants from the electrowinning solution.

One such contaminant which can pass from the leach through the solvent extraction step and into the electrowinning solution is one which causes corrosion or pitting of the stainless steel cathode during electrowinning. The corrosion of the cathode occurs in the splash zone which is just above the liquid level of the electrowinning solution. Heavy corrosion or pitting of the cathode is detrimental to the electrowinning step.

While not wishing to be bound by theory, it appears that the contaminant which may cause the corrosion of the steel cathode is a chlorine derivative. The derivative is apparently a chloride which is present in the initial leaching of copper from its ore, and which appears to pass into the organic solvent extraction step and into the stripping solution, and thus becomes part of the electrowinning solution. Upon passing of a current through the solution, evolution of free chlorine is observed. It is also observed that corrosion of the cathode does not occur in the body of the electrowinning solution when a current is applied as there appears to be some inhibitory effect present. In the air space above the solution, free chlorine can be quickly driven away by gas extraction. However, in the splash zone on the cathode, droplets are separated from the main electrowinning solution, and pitting or corrosion of the cathode occurs in this area.

Another consideration in electrowinning systems, but not electrorefining systems, is that for maximum efficiency, the spent electrowinning solution is recycled to the solvent extraction step. Thus, there is a need to ensure that continued recycling does not effect the efficiency of the solvent extraction step, or the electrowinning step, due to build-up of contamination. Thus, the current teaching is that it is undesirable to introduce any form of additives into the electrowinning solution.

After much research and experimentation, it has now been found that corrosion of the steel cathode in a copper electrowinning system can be reduced if the observed level of free chlorine can also be reduced. The present invention has identified compounds which can form part of the electrowinning solution and which compounds reduce, or cause to reduce, the level of free chlorine. Although it is postulated that the free chlorine causes corrosion of the cathode, it may also be possible that corrosion is caused by some other moiety. However, it is noted that an additive which reduces the level of free chlorine also tends to result in a reduction of corrosion of the steel cathode in the splash zone.

OBJECT OF THE INVENTION

In one form, the invention resides in an electrowinning system having a steel cathode and where the electrowinning solution includes at least one compound which causes a reduction in the level of free chlorine being evolved from the system.

The electrowinning system is suitably a copper electrowinning system. The electrowinning solution suitably comprises the strip solution from a solvent extraction step of a copper leach solution.

The at least one compound may be selected from a thiourea or a derivative thereof, an alkyl sulphonate surfactant such as AVITONE (trade mark of E. I. DU PONT DE NEMOURS AND CO INC), or a protein glue.

To improve the effect of the at least one compound in reducing corrosion of the cathode, it is; preferred that chloride levels in the electrowinning solution are less than about 150 ppm, and a preferred range of chloride is between 30–90 ppm.

As the electrowinning solution may be recycled either continuously, or many times to the solvent, extraction step, it is preferred that the at least one compound has a low solubility in the solvent of the solvent extraction step, relative to its solubility in the aqueous stripping solution. In this way, build-up of the at least one compound in the solvent is reduced.

The at least one compound can be selected from those which function to reduce the levels of free chlorine over an appreciable period of time. Thus, the at least one compound can be selected from those which either do not degrade in the electrowinning solution, or if degradation does occur, that the degradation products are also at least partially effective in reducing the level of free chlorine.

A suitable range of the at least one compound is between about 1 to about 30 ppm, with a preferred range being between about 1.4 to 3 ppm. A preferred compound to be added to the electrowinning solution is thiourea.

If thiourea is used, the amount used may be stated in terms of grams of thiourea per ton of copper plated during the electrowinning process. At 1.9 ppm of thiourea, about 272 grams of thiourea may be used per ton of copper plated.

This may be excessive as not all of the thiourea may be consumed. The thiourea may be consumed by the plated copper, degraded by the acid, decomposed by the highly oxidative environment of the anode, or pass through unreacted.

BEST MODE

Figure 1:
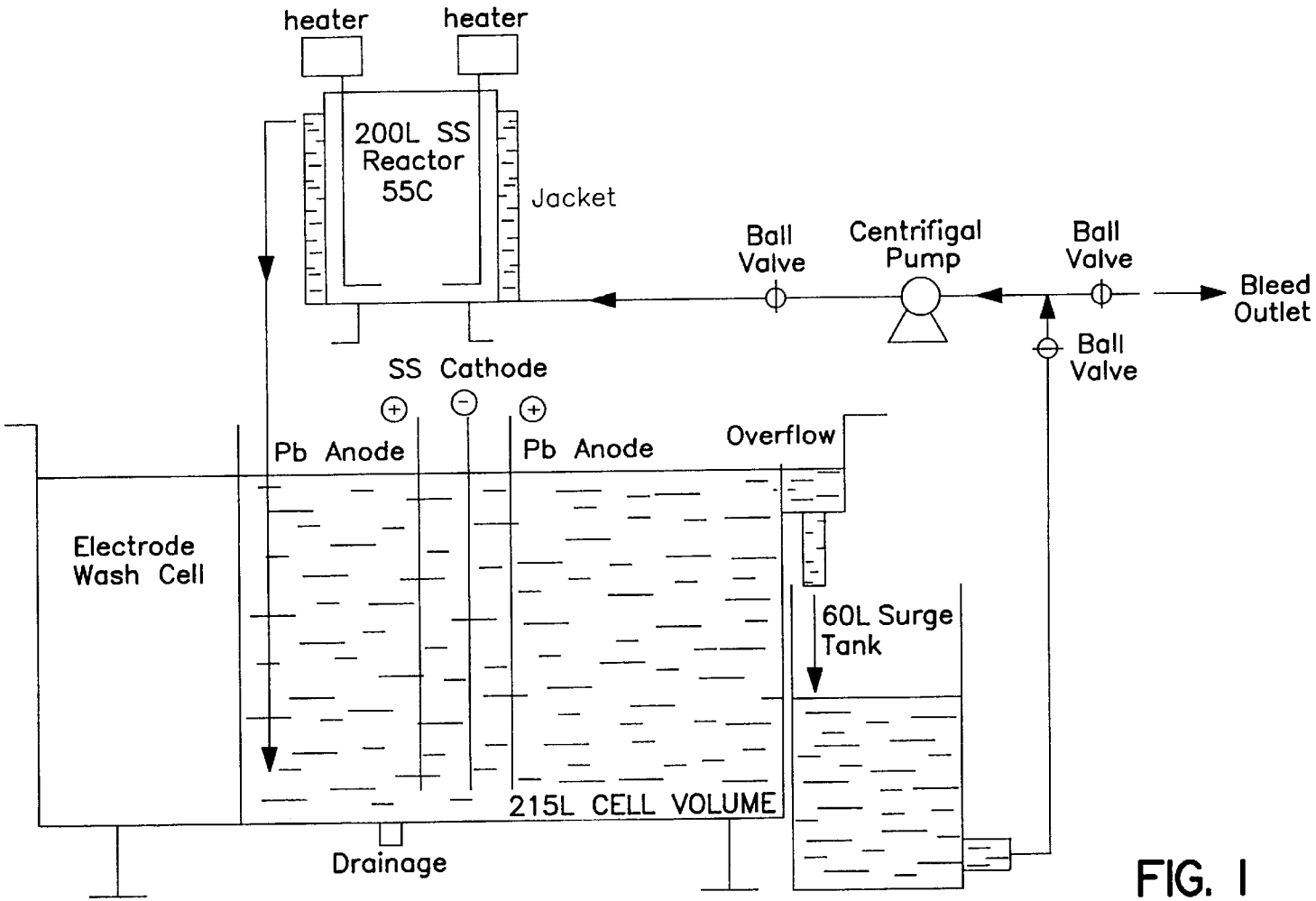
FIG. 1 exemplifies an electrowinning cell for a copper electrowinning system.

A series of tests were run using an acidified copper sulphate solution. The initial tests were conducted in a 1 litre cell fitted with an over-flow so that the cell contained only 500 ml of electrolyte. The distance between the lead anode and the stainless steel cathode was 1.5 cm. The cell was situated in a water bath at 45° C. Electrolyte was stored in a 20 litre reservoir, also maintained at 45° C., and was pumped into the cell at the rate of 8 ml/min. Exiting electrolyte was recycled. The stainless steel cathode contained 16–18% Ni, 2–3% Mo, and a low carbon content. The back of the plates and the edges were covered to expose only the required surface area for plating. The tests were run for 7 days, during which the chloride concentration of the cell was measured using a Drager tube. The parameters were as follows:

| | |
|---|---|
| Current density | 260 A/m$^2$ |
| Temperature | 45° C. |
| Flow rate | 8 mL/min |
| Cell electrolyte volume | 500 mL |
| Cathode | 316 L stainless steel |
| Anode | Lead |
| Copper | 30 g/L |
| Sulphuric acid | 160 g/L |
| Chloride | 80–200 ppm (depending on the test) |

During the run period, copper was plated onto the cathode.

Table 1 shows the effects of thiourea on corrosion and varying chloride concentrations:

| THIOUREA (ppm) | CHLORIDE (ppm) | DRAGER TUBE READING (ppm $Cl_2$) | PITS (Yes/No) |
|---|---|---|---|
| 1.9 | 80 | 0.7 | No |
| 0.7 | 80 | 0.5 | Yes |
| 1.4 | 80 | 0.3 | No |
| 1.9 | 110 | 1.0 | No |
| 1.9 | 130 | 0.7 | No |
| 1.9 | 150 | 2.0 | No |
| 1.9 | 200 | >3.0 | Yes |

-continued

| THIOUREA (ppm) | CHLORIDE (ppm) | DRAGER TUBE READING (ppm $Cl_2$) | PITS (Yes/No) |
|---|---|---|---|
| 1.0 | 80 | 0.5 | No |
| 0.5 | 80 | 1.5 | Yes |
| 4.0 | 200 | >3.0 | Yes |

Table 1 shows that thiourea added to an amount of between 1 to about 2 ppm reduces the level of chlorine evolution when the chloride concentration in solution is between 80 to about 150 ppm. At chloride level of 200 ppm, thiourea was no longer found to be able to prevent corrosion, even if the amount of thiourea was increased.

Table 2 shows the effect of other organic additives in preventing corrosion of the steel cathode.

| ADDITIVES | CHLORIDE CONC. (ppm) | PITS OBSERVED (YES/NO) | FREE $Cl_2$ (DRAGER TUBE) READING (ppm) |
|---|---|---|---|
| No additives | 100 | Yes (L) | 0.5 |
| 0.8 ppm glue<br>1.9 ppm thio.<br>0.2 ppm avitone | 100 | No | 1.0 |
| 0.8 ppm glue<br>0.2 ppm avitone | 80 | No | — |
| 0.8 ppm glue<br>1.9 ppm thio.<br>0.2 ppm avitone | 80 | No | — |
| 0.8 ppm glue | 80 | No | — |
| 0.2 ppm avitone | 80 | No | — |

At chloride concentrations of greater than about 200 ppm, glue and AVITONE were no longer found to inhibit corrosion of the cathode. The glue was a protein glue similar to that added in electrorefining cells.

A pilot system is illustrated in FIG. 1, and the cell conditions were as follows:

| | |
|---|---|
| Current density | 260 A/m$^2$ |
| Temperature | 45° C. |
| Flow rate | 900 mL/min |
| Cell Electrolyte Volume | 215 L |
| Cathode | 316 stainless steel (SS) |
| Anode | 2 × Lead |
| Copper | 30 g/L |
| $H_2SO_4$ | 160 g/L |
| Thiourea | 1.9 ppm |
| Chloride | 80 ppm |

Electrolyte entered the base of the cell at 900 ml/min and exited via the overflow weir. The overflow electrolyte was collected in a surge tank (60 L) and was pumped via a centrifugal pump into the jacket of a 200 L 316 SS reactor. From the reactor the electrolyte relied on gravity to feed back into the electrowin cell, completing the circuit.

The surge tank acted as an intermediate storage ensuring that air flowing down the overflow weir did not flow through the pump and cause cavitation. The electrolyte was heated to the required 45° C. by running it through the jacket of a reactor containing water heated to 55° C. using thermostatically controlled electric heaters.

Ball valves were placed before and after the centrifugal pump to enable the variation of flow rate and the collection of a bleed.

The SS plate, bordered by PVC edge strips, used had a total plating area of 0.5 m$^2$. Two lead anodes were placed on either side of the cathode at a anode-cathode distance of 1.5 cm. A variable current rectifier was used for the experiment with the required current density set by adjusting the current output of the rectifier.

The cell was run for a period of five days. 3.7 kg of Cu was plated per day with the generation of 5.7 kg of $H_2SO_4$. Each day a 32 L bleed was collected to remove the excess acid. Copper sulphate, thiourea and chloride was added to the cell to replace these constituents removed during acid bleed and the copper that was plated out on the cathode.

Repetitive use of the stainless steel cathode in electrowinning solutions having a chloride. concentration 80 ppm showed no visible pitting. That is, four uses of the stainless steel cathode, including removal of the cathode from the cell, stripping of the copper and replacing the cathode in the cell for further plating showed no visible pitting after 18 days of electrowinning. This was using 1.9 ppm thiourea as the protecting agent.

The overall result showed that thiourea at 1.9 ppm was effective in inhibiting chloride corrosion of stainless steel cathodes at chloride levels below about 150 ppm. Chloride levels at 200 ppm pitted the cathode even when the thiourea concentration was doubled to about 4 ppm. Repetitive tests with a thiourea concentration of 1.9 ppm and a chloride concentration of 80 ppm showed no pitting above the solution line. Thiourea is known to be unstable in an electrolyte strength acid solution with a half life of about 3 hours. It would therefore appear that the derivatives of thiourea from its hydrolysis or its reaction with cuprous or cupric must also be effective in inhibiting corrosion, as there was no continuous dosing of thiourea to make up for thiourea degradation in the system. The plated copper on the cathode had a sulphur level of 11 ppm. On the larger scale system as illustrated in FIG. 1, again no sign of pitting was observed on the cathode, with thiourea being added at a low dosing rate of 0.4 ppm/day. The low dosage rate is not sufficient to make up for degradation which again indicates that the thiourea derivatives are also corrosion inhibitors.

With recycling of the electrowinning solution to the solvent extraction step, it was noted that some thiourea or its derivatives passed into the organic solvent. It was observed that these products had no apparent detrimental effect on the performance or stability of the solvent extraction step. The phase separation between the solvent and the leach solution was not appreciably affected by the addition of thiourea or its derivatives in the solvent.

It should be appreciated that various other changes and modifications may be made to the embodiment described without departing from the spirit and scope of the invention.

We claim:

1. A method of reducing corrosion of a stanless steel cathode in an electrowinnig system, wherein (a) a metal from an electrowinning solution is electrowon on a stainless steel cathode, the metal having been separated from a metal-bearing mineral by the steps of leaching said metal from said mineral into a leachate, extracting the metal from the leachate with an organic solvent and stripping the metal from the organic solvent into the electrowinning solution;

(b) a surface of said cathode comprises a lower surface portion which remain below a liquid level of the electrowinning solution during electrowinning and an upper surface portion which remains above the liquid level of the electrowinning solution during electrowinning, the upper surface portion having a splash zone located immediately above the liquid level of the electrowinning solution, (c) the electrowinning solution has a chloride level above 30 ppm and free chlorine evolves from the electrowinning system when a current is passed through the system; and (d) the cathode is removed from the electrowinning solution after the metal has been electrowon on the cathode, the electrowon metal is stripped from the lower surface portion of the cathode, the electrowinning solution is recycled to the stripping step, and the cathode is replaced in the electrowinning solution, said method being for reducing corosion of the upper surface portion of the cathode in the splash zone, the method comprising reducing the amount of free chlorine evolved from the electrowinning system by maintaining in the electrowinning solution an amount in a range from about 1–30 ppm of at least one compound selected from the group consisting of thiourea, and derivatives of thiourea, for causing a reduction in free chlorine evolved from said electrowinning solution.

2. The method of claim 1, further comprising maintaining said at least one compound in said solution in a range of about 1.4–3 ppm.

3. The method of claim 1, wherein said electrowinning solution has a chloride level below about 150 ppm.

4. The method of claim 3, wherein said chloride level is between 30–90 ppm.

5. The method of claim 1, wherein said electrowinning solution is a copper electrowinning solution.

* * * * *